US006367276B1

(12) United States Patent
Kim et al.

(10) Patent No.: US 6,367,276 B1
(45) Date of Patent: Apr. 9, 2002

(54) VEGETABLE COMPARTMENT IN REFRIGERATOR

(75) Inventors: Eun Jeong Kim; Yong Seok Park; Young Chul Son, all of Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/830,071

(22) PCT Filed: Sep. 1, 2000

(86) PCT No.: PCT/KR00/00998

§ 371 Date: Apr. 23, 2001

§ 102(e) Date: Apr. 23, 2001

(87) PCT Pub. No.: WO01/17368

PCT Pub. Date: Mar. 15, 2001

(30) Foreign Application Priority Data

Sep. 3, 1919 (KR) ..... 99-37493
Apr. 3, 2000 (KR) ..... 00-17418

(51) Int. Cl.[7] ..... F25D 21/14
(52) U.S. Cl. ..... 62/288; 62/290

(58) Field of Search ..... 62/288, 285, 290, 62/281

(56) References Cited

U.S. PATENT DOCUMENTS

| | | | | |
|---|---|---|---|---|
| 2,267,486 A | | 12/1941 | West | |
| 3,213,639 A | * | 10/1965 | Schumacher et al. | 62/281 |
| 4,198,222 A | * | 4/1980 | Wood | 62/281 |
| 4,788,832 A | * | 12/1988 | Aoki et al. | 62/382 |
| 4,949,847 A | | 8/1990 | Nagata | |
| 5,392,615 A | * | 2/1995 | Lim | 62/414 |
| 5,918,480 A | * | 7/1999 | Nagata et al. | 62/440 |

FOREIGN PATENT DOCUMENTS

| | | |
|---|---|---|
| EP | A2505171 | 9/1992 |
| JP | A2-11083300 | 3/1999 |

* cited by examiner

*Primary Examiner*—William E. Tapolcai
*Assistant Examiner*—Mohammad M. Ali

(57) ABSTRACT

Vegetable compartment in a refrigerator including a partition for forming a vegetable storage space in a cold storage room, a container for being accommodated in the vegetable storage space, and a cover over the container, the cover having water collecting means on a bottom surface, thereby permitting fresh and prolonged storage of vegetables.

16 Claims, 9 Drawing Sheets

VEGETABLE COMPARTMENT IN REFRIGERATOR

This application is the national phase under 35 U.S.C. §371 of PCT International Application No. PCT/KR00/00998 which has an International filing date of Sep. 1, 2000, which designated the United States of America and was published in English.

BACKGROUND OF THE INVENTION

1. Field of the Invention

The present invention relates to a refrigerator, and more particularly, to a vegetable compartment in a refrigerator for storage of vegetables separate from other food in a cold storage room of a refrigerator.

2. Background of the Related Art

In general, separate from a general food storage chamber, the refrigerator has the vegetable compartment in a lower part of the cold storage room for storage of vegetables. As shown in FIG. 1, such a vegetable compartment is provided with a partition 6 for forming a vegetable storage space in the cold storage room 2, and a container 4 in the storage space. The container 4 having an opened top is covered by the partition 6 fitted to sidewalls 2*a* and 2*b* of the cold storage room 2, and opened/closed by pulling/pushing the container 4, i.e., by pulling the container 4, the opened top of the container 4 is exposed, through which vegetables may be stored or taken out.

In general, inside of the container 4 may be cooled, directly, or indirectly. However, even if the inside of the container 4 is cooled, an inside temperature of the container 4 is slightly higher than a temperature of the cold storage room 2. Actually, taking storage characteristics of vegetables into consideration, the inside temperature of the container 4 is set to maintain a temperature slightly higher than the temperature of the cold storage room 2, with a consequential temperature difference between the inside of the container 4 and the cold storage room 2 Particularly, while a top surface of the partition 6 is at a low temperature as the top surface is exposed to the cold storage room 2, a bottom surface of the partition 6 is at a relatively high temperature as the bottom surface is exposed to the inside of the container 4, to cause dewing in which moist inside of the container 4 with the relatively higher temperature is condensed on the bottom surface of the partition 6. As the cooling is kept on, the moist condensed on the bottom surface of the partition 6 grows into water drops, until the water drops drop into the container 4 as weight of the water drops is greater than a surface tension of the water drops. FIG. 2 illustrates the drop of the water drops formed on the bottom surface of the partition 6, schematically. At the end, the water drops accelerate decomposition of the vegetables resulting in earlier degradation of freshness of the stored vegetables.

In the meantime, the moist in air in the cold storage room 2 deposits on a surface of an evaporator to grow into frost because a surface temperature of the evaporator is very low during operation of the refrigerator. As this process is kept on, actually the cold storage room 2, more particularly, the inside of the container 4 is dried, to degrade the freshness of the stored vegetables, significantly.

There have been many efforts for solving such a problem, which will be explained, briefly. For preventing falling of the water drops, EP 0 505 171 B 1 discloses a partition having a plurality of grooves in a bottom surface to be mounted with a slope for discharge the water drops outside of the container. However, EP 0 505 171 B 1 has disadvantages in that the system is complicated and occupies much space because a separate member is required for collecting the water drops flowing along the sloped partition and discharging out of the refrigerator. Moreover, EP 0 505 171 B 1 fails to maintain humidity of the container appropriately, actually. And, Korean Utility Model publication No. 10-1997-14694, or Korean Patent Publication No. 10-1997-28396 discloses a humidity filter having active carbon which has an excellent adsorptivity mixed therein fitted inside of the container, for adsorbing moisture vaporized from the vegetables to maintain a humidity, as well as ethylene gas produced by oxidation as the air flows in. Korean Utility Model publication No. 10-1997-63487 discloses a lattice of housings formed in the bottom surface of the partition of the container, each of which forms a space opened to inside of the container having a shape memory net and a humidity filter fitted therein in succession, for absorbing the moisture vaporized from the vegetables and discharging the absorbed moisture when the container is dry. The shape memory net permits to discharge the moisture to the cold storage room when the absorbed moisture is excessive, for maintaining the humidity inside of the container constant.

However, the disclosures can not prevent the dewing intrinsically even if the humidity filter having active carbon mixed therein is fitted to an appropriate places on the bottom surface of the partition because the dewing on the bottom surface of the partition is caused by the temperature difference between the top surface and a bottom surface thereof. And, the periodic replacement of the humidity filter causes inconvenience and cost increase.

SUMMARY OF THE INVENTION

Accordingly, the present invention is directed to a vegetable compartment in a refrigerator that substantially obviates one or more of the problems due to limitations and disadvantages of the related art.

An object of the present invention is to provide a vegetable compartment in a refrigerator, which can prevent water drops formed by a temperature difference between a vegetable compartment and a cold storage room from falling down onto vegetables stored in the compartment.

Other object of the present invention is to provide a vegetable compartment in a refrigerator which can maintain a humidity in a container appropriately.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the vegetable compartment in a refrigerator includes a partition for forming a vegetable storage space in a cold storage room, a container for being accommodated in the vegetable storage space, and a cover over the container, the cover having water collecting means on a bottom surface.

The water collecting means includes a plurality of ribs formed to cross one another each having a fixed width and a fixed height extended downward, and a plurality of water collecting spaces formed by the ribs, and preferably further includes supplementary water collecting means for substantially increasing a surface area of the water collecting means.

Preferably, the supplementary water collecting means is a cavity formed at ends of the ribs at a cross of the ribs in a semispherical form.

Preferably, the supplementary water collecting means includes a supplementary rib in the water collecting space, and a supplementary water collecting space formed by the supplementary rib, to have a height lower than a height of the rib in a cross from, or circular form.

Preferably, the supplementary water collecting means includes a cavity formed at ends of the ribs, and a supplementary rib formed in the water collecting space and a supplementary water collecting space formed by the supplementary rib.

The water collecting means includes a plurality of metal strips each having a fixed width and a fixed thickness crossed one another, and a plurality of water collecting spaces formed by the strips, and preferably, the cover includes the water collecting means only.

In another aspect of the present invention, there is provided a vegetable compartment in a refrigerator including a partition for forming a vegetable storage space in a cold storage room, the partition having water collecting means on a bottom surface, and a container for being accommodated in the vegetable storage space Different forms of the water collecting means can be applied regardless of the structure and function and have the same effect.

Thus, the present invention can make a stable hold of the water drops and maintain a humidity inside of the container at an appropriate level.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a flier understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In explaining the present invention, identical parts will be given the same names and reference symbols, and repetitive explanations of the parts will be omitted.

Figure 1:
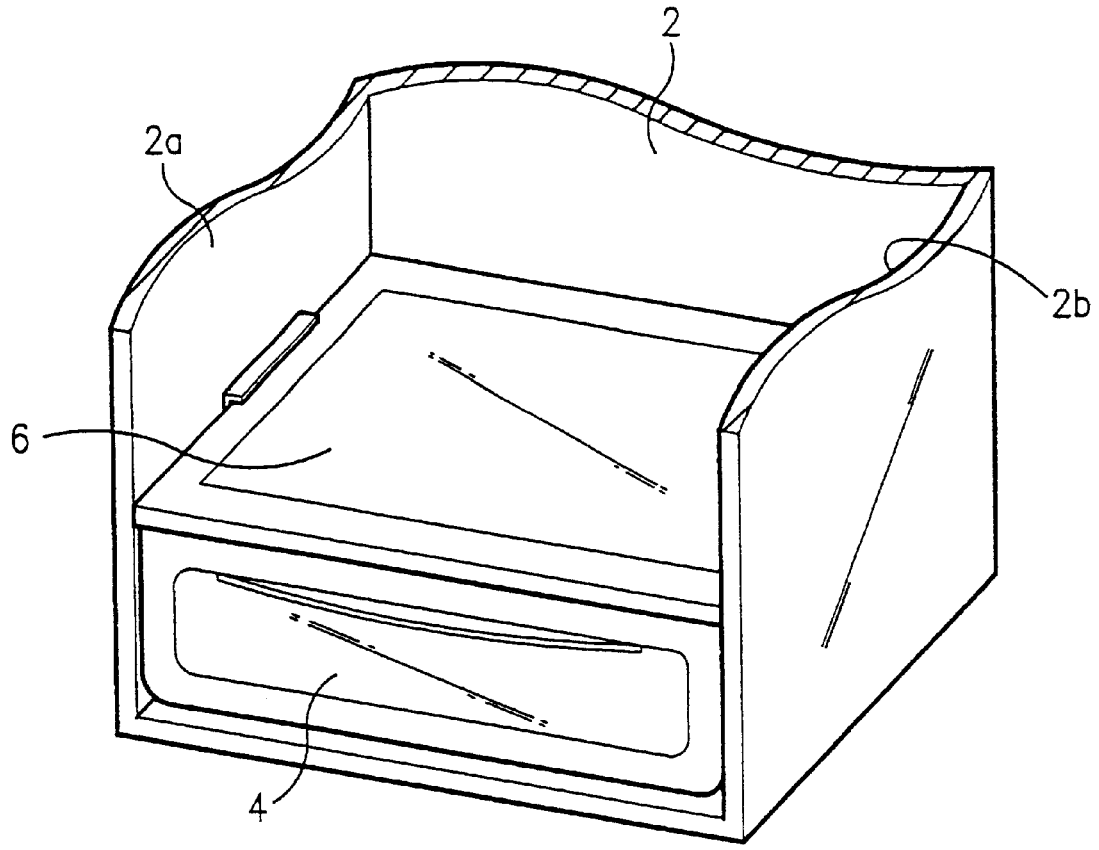
FIG. 1 Related Art
FIG. 1 illustrates a perspective view of a related art vegetable compartment.
Figure 2:
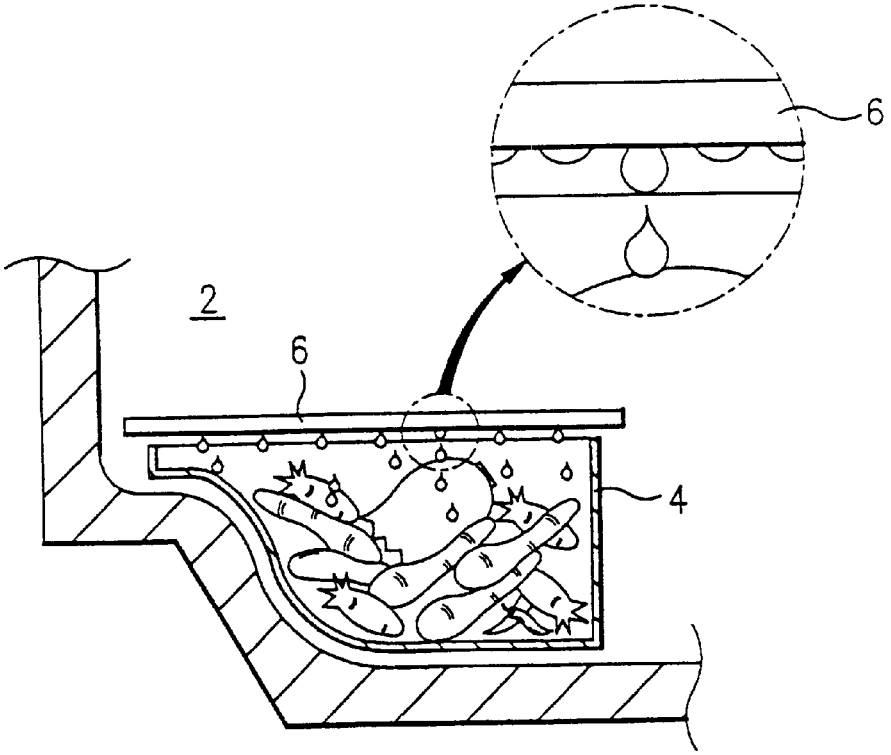
FIG. 2 Related Art
FIG. 2 illustrates a side section of a related art vegetable compartment.
Figure 3:
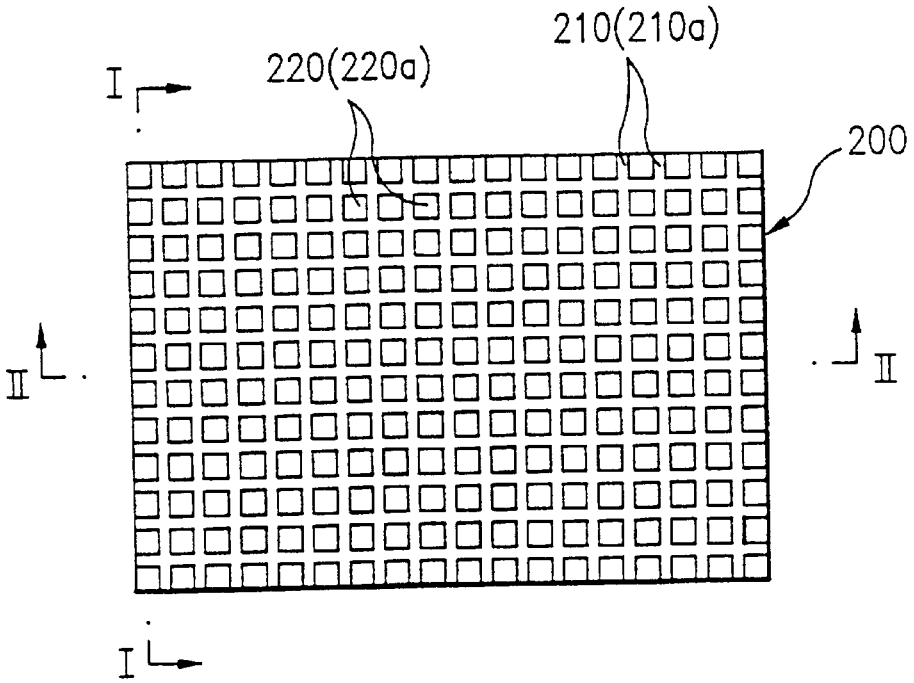
FIG. 3 illustrates a bottom view of a cover of a vegetable compartment in accordance with a first preferred embodiment of the present invention.
Figure 4:
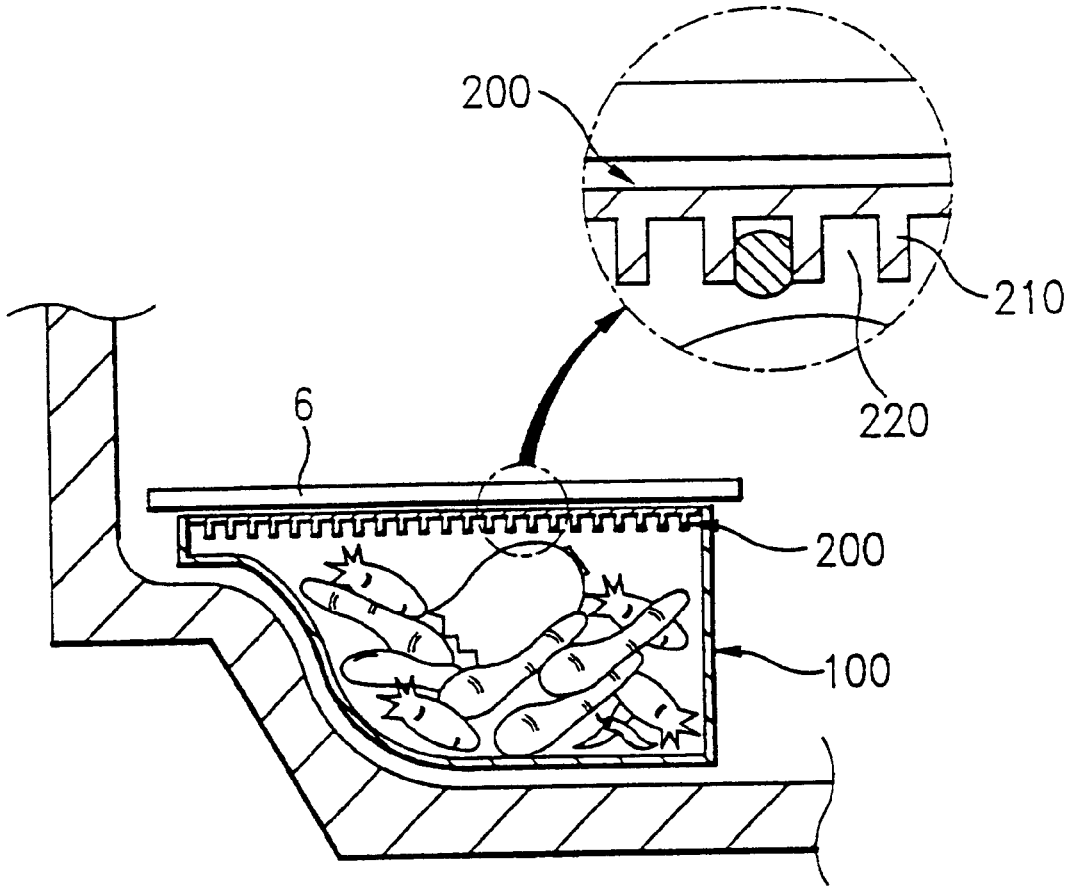
FIG. 4 illustrates a side section of a cover of a vegetable compartment in accordance with a first preferred embodiment of the present invention having one embodiment of water collecting means applied thereto.

FIG. 3 illustrates a bottom view of a cover of a vegetable compartment in accordance with a first preferred embodiment of the present invention, and FIG. 4 illustrates a side section of a cover of a vegetable compartment in accordance with a first preferred embodiment of the present invention having one embodiment of water collecting means applied thereto.

The vegetable compartment in accordance with a first preferred embodiment of the present invention includes a cover 200 having water collecting means on a bottom surface fitted over a conventional container, together with a conventional partition and the container. The water collecting means includes a plurality of ribs 210 each having a width and a height extended downward form a bottom surface of the cover 200 crossing one another and a plurality of water collecting spaces 220 formed by the ribs 210. As the plurality of ribs 210 are crossed, the plurality of water collecting spaces 220 each having a top portion closed by the cover, sides closed by the crossed ribs, and a bottom portion opened only are formed. A form of the water collecting space 220 can be varied depending on types of crossing of the ribs 210, i.e., an arrangement of the ribs 210, and the form of the water collecting space in the present invention, inclusive of the first embodiment, will be based on a square. Moreover, the water collecting means also may be formed by crossing the ribs 210, but also a plurality of circular or polygonal ribs of fixed forms under the cover 200 and a plurality of water collecting spaces formed by the ribs.

Functions of the vegetable compartment in accordance with the first preferred embodiment of the present invention having the water collecting means with the foregoing ribs applied thereto will be explained, with reference to FIGS. 5A~5D.

Figure 5A:
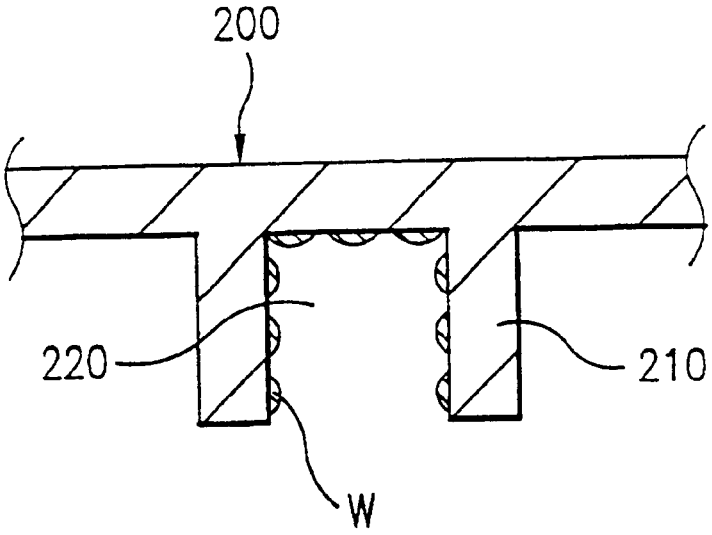
FIGS. 5A~5D illustrate a process of growth of a water drop in the water collecting means in FIG. 4.
Figure 5B:
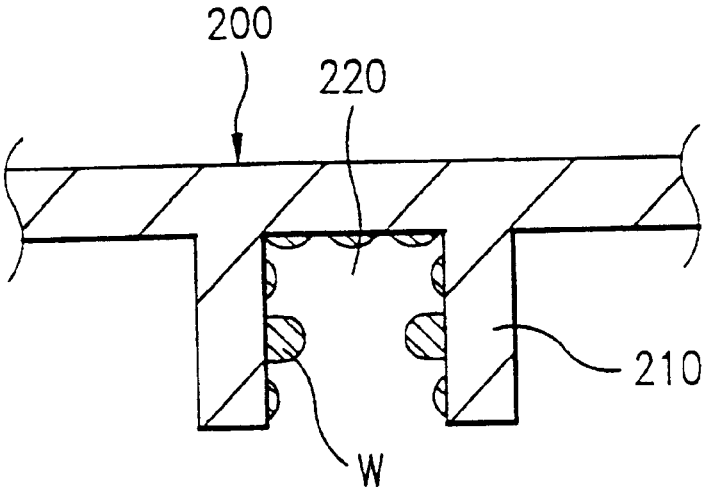
Figure 5C:
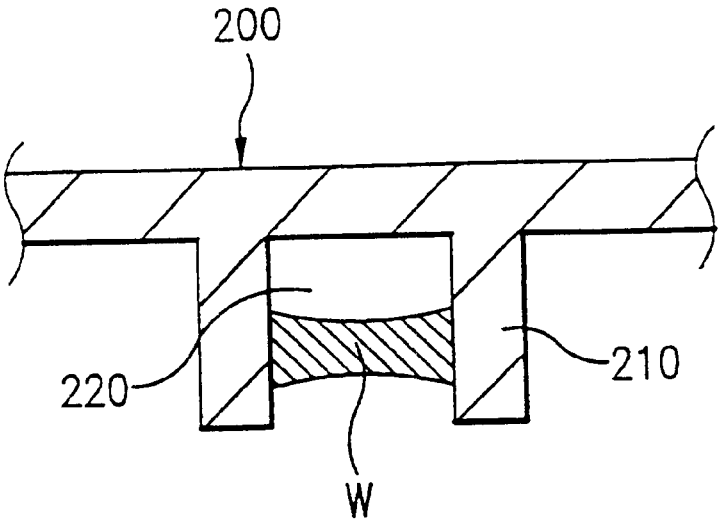
Figure 5D:
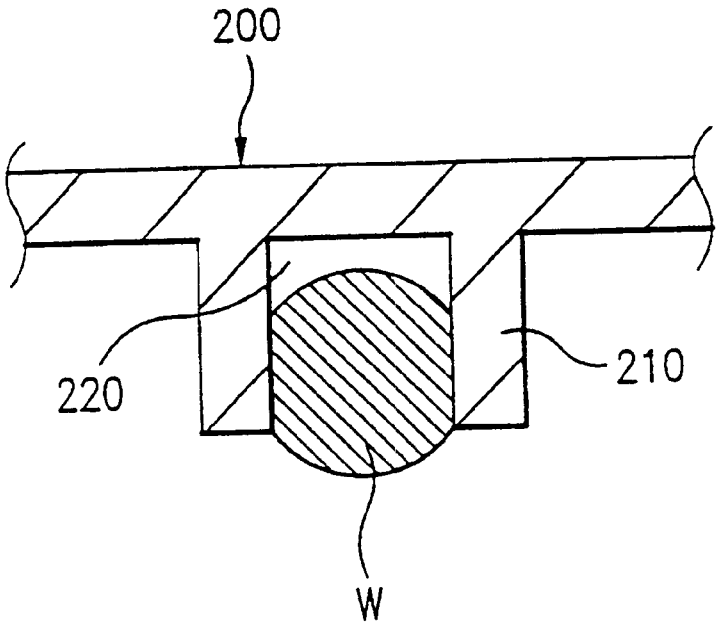

As the process of formation of a water drop on the cover 200 caused by a temperature difference between the container 100 and cold storage room 2 is the same with the one explained already, explanation of the process will be omitted. The water drops formed on the bottom surface of the cover 200 by the dewing are contained in the plurality of in the water collecting spaces 220 formed as the plurality of ribs 210 are crossed. FIGS. 5A illustrates an initial state of the water drops 'W' contained in the water collecting space 210, when there are small water drops formed on the bottom surface and the sidewalls of the ribs 210, and, as shown in FIG. 5B, as the dewing is continued, adjacent water drops merge into a larger water drop. And, as shown in FIG. 5C, as the water drop 'W' continues to grow, the water drop forms a bridge, to form a water drop 'W' which fills the water collecting space 220 fully, at the end. The large water drop 'W' in the water collecting space 220 does not drop into the container 100 because a surface area composed of the bottom surface and the side surface of the ribs 220 to which the water drop is in contact is large. That is, the large surface area provides a large surface tension enough to support weight of the water drop 'W' itself, the water drop 'W' in the water collecting space 220 does not drop. And, as explained, if the vegetable compartment, more particularly, inside of the container 100 is dry, the water drop 'W' in the water collecting space 220 is vaporizes, to maintain the inside of the container 100 at an appropriate humidity. Accordingly, the vegetable compartment in accordance with a first preferred embodiment of the present invention prevents decomposition of the vegetable by holding the water drops in the water collecting spaces 220 when a humidity inside of the container 100 is high, and maintains the inside of the container to be at an appropriate humidity as the water drops in the water collecting spaces 220 vaporizes when the inside of the container is dry, thereby allowing storage of refresh vegetables for a long time.

Figure 6:
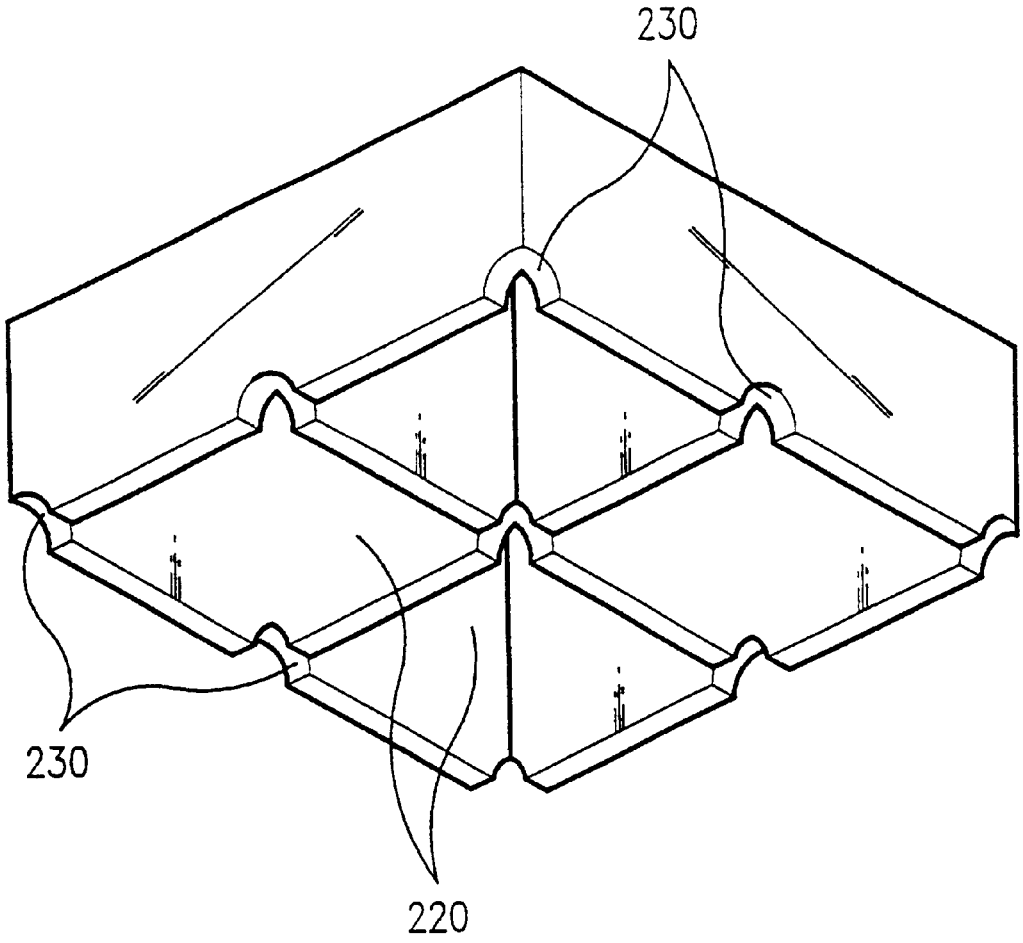
FIG. 6 illustrates a perspective view of a modification of the water collecting means.

The water collecting means with the ribs may have supplementary water collecting means for efficient containment of the water drops, and FIG. 6 illustrates a perspective view of a modification of the water collecting means having the supplementary water collecting means.

Referring to FIG. 6, the supplementary water collecting means includes a plurality of cavities 230 at ends of the ribs 210. That is, in the modification of the water collecting means, a plurality of ribs 10 are crossed, to form a plurality of water collecting spaces 220, and a cavity 230 at every cross of the ribs 210 as supplementary water collecting means, to increase a surface area of a lower portion of the ribs 210. Accordingly, water drops formed, not only in the water collecting spaces 220, but also in a lower surface of the ribs 210 can be stored in the cavity 230. And, the cavity 230 may be formed larger than the cross of the ribs 220, to permit adjacent water collecting spaces 220 in communication, the water drops may move between adjacent water collecting spaces through the cavity 230, that permits uniform storage of the water drops in all of the water collecting spaces 220 because a large water drop grown in one water collecting space 220 may move to other water collecting spaces 220 in which no water drop or only minute water drops are formed. With regard to the formation of the cavity 230 in the ribs 210, the cavity 230 may be formed, not limited to the cross of the ribs 210, but at a portion at which the ribs 210 are not crossed, of which function is the same. And, though the cavity 230 may have a variety of forms, a semispherical form is preferable for actual increase of the surface area and for stable holding of the water drop.

Figure 7:
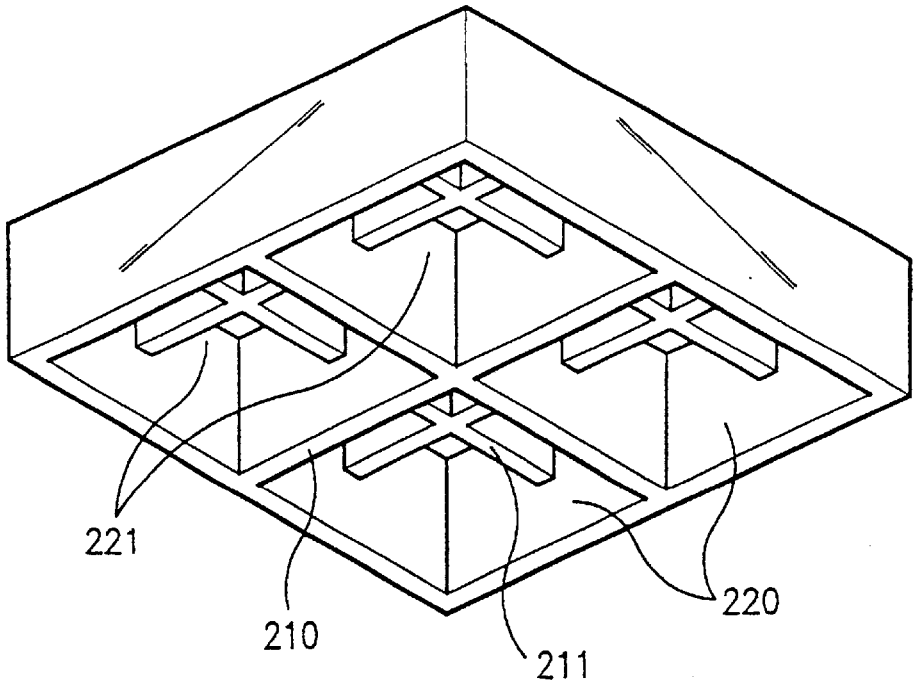
FIGS. 7 and 8 illustrate perspective views of another modifications of the water collecting means.
Figure 8:
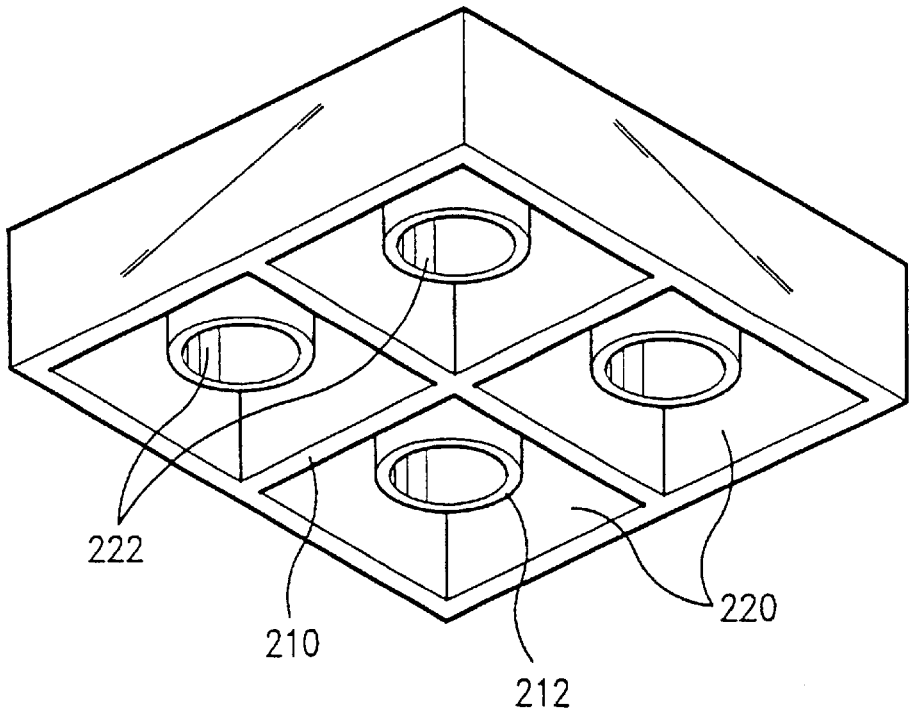

FIGS. 7 and 8 illustrate perspective views of another modifications of the water collecting means having supplementary water collecting means.

The another modification supplementary water collecting means includes a supplementary rib 211 or 212 formed in a water collecting space 220, and a supplementary water collecting space 221 or 222 formed by the supplementary rib 211 or 212. The supplementary rib 211 or 212 has a height lower than a height of the rib 210, because, if the height of the supplementary rib 211 or 212 is higher than or equal to the height of the rib 210, a volume of the water collecting means may be reduced due to the volume of the supplementary rib 211 or 212 itself. In the foregoing supplementary water collecting means shown in FIG. 7, a cross form of supplementary rib 211 is formed in the water collecting space 220 for increasing a surface area for stable holding of the water drop formed in the water collecting space 220 and the supplementary water collecting space 221. That is, the water drop makes uniform contact with the sides of the water collecting space, and an upper side surface area of the water drop is increased for stable holding of even larger water drop. In addition to this, the water drop formed in the supplementary water collecting space 250 before growth to a larger water drop is also has an increased surface area by the supplementary rib 221, stable holding of the water drop is also possible. And, as shown in FIG. 8, the supplementary water collecting means may include a circular supplementary rib 212 and a supplementary water collecting space 212 in the water collecting space 220. This circular supplementary rib 212 can provide the same function and effect as the one in FIG. 7 explained before. The supplementary rib may be a form other than the cross form, and may not be circular, but polygonal, with the same function and effect explained before. And, though not shown, it is preferable that the modifications in FIGS. 6 to 8 are applied to the water collecting means having the ribs, all together. That is, the cavity 230 in FIG. 6 is formed at the cross of the ribs 210, and the supplementary rib 211 or 212 and the supplementary water collecting space 221 or 222 are formed in the water collecting space 220 according to FIG. 7 or 8, for obtaining a combined effect of holding the water drop formed under the bottom surface of the rib 210 and permitting stable growth of the water drop in the water collecting space.

Figure 9A:
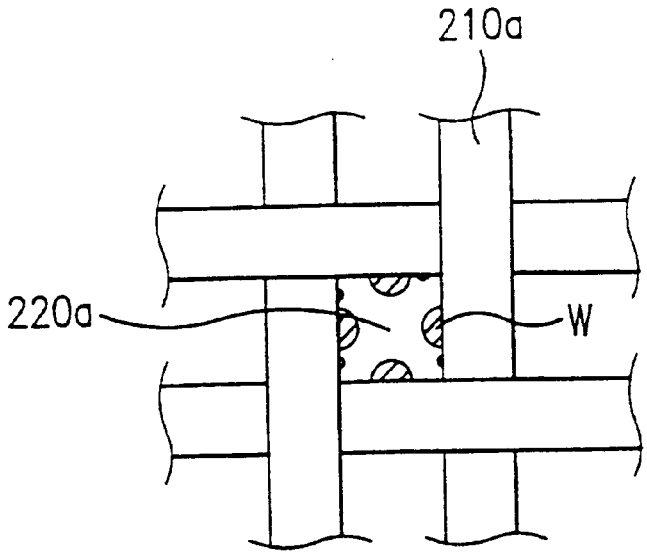
FIGS. 9A and 9B illustrate plan views of another embodiment of the water collecting means; and, FIG. 10 illustrates a side section of a vegetable compartment in accordance with a second preferred embodiment of the present invention.
Figure 9B:
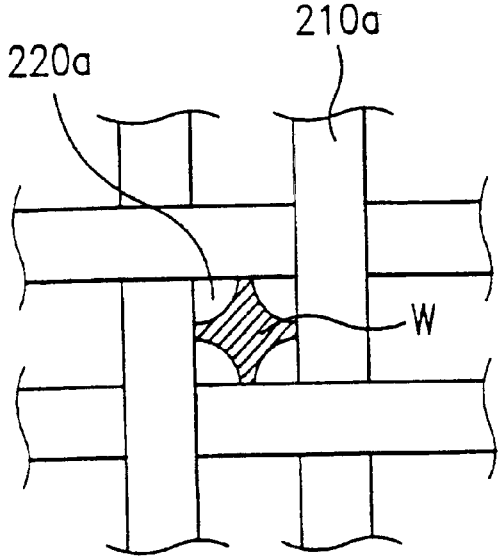

In the meantime, another form of water collecting means may be provided to the cover 200, which will be explained with reference to FIGS. 3 and 9A and 9B.

The another form of water collecting means includes a plurality of metal strips 210*a* each with a fixed width and thickness crossed each other and a plurality of water collecting spaces 220*a* formed by the strips. Each of the water collecting spaces between every crossing of the plurality of metal strips 210*a* has a top portion closed by the cover 200 and an opened bottom portion. According to this, as shown in FIG. 3, when it is seen from a bottom of the cover 200, the water collecting means has an outline similar to the water collecting means having the ribs in overall. And, similar to the water collecting means having the ribs, the water collecting space 220*a* may have a variety of forms depending on forms of crossing of the strip 210, i.e., arrangement of the strip 210*a*. The cover may only consist of the water collecting means of the metal strips. That is, the water collecting means is placed over the container 100 instead of the cover, for protecting the vegetable in the container 100. When the vegetable compartment having the water collecting means is cooled down, directly or indirectly, the water collecting means is cooled down at first as the water collecting means is formed of a metal having a high thermal conductivity, that causes concentrated occurrence of the dewing at the water collecting means. Then, the growth and holding process of the water drop 'W' formed as shown in FIGS. 9A and 9B are progressed similar to the water collecting means having the ribs. And, the stable holding of, and the humidity maintenance by, the water drop 'W' are also similar to the water collecting means having the ribs.

Figure 10:
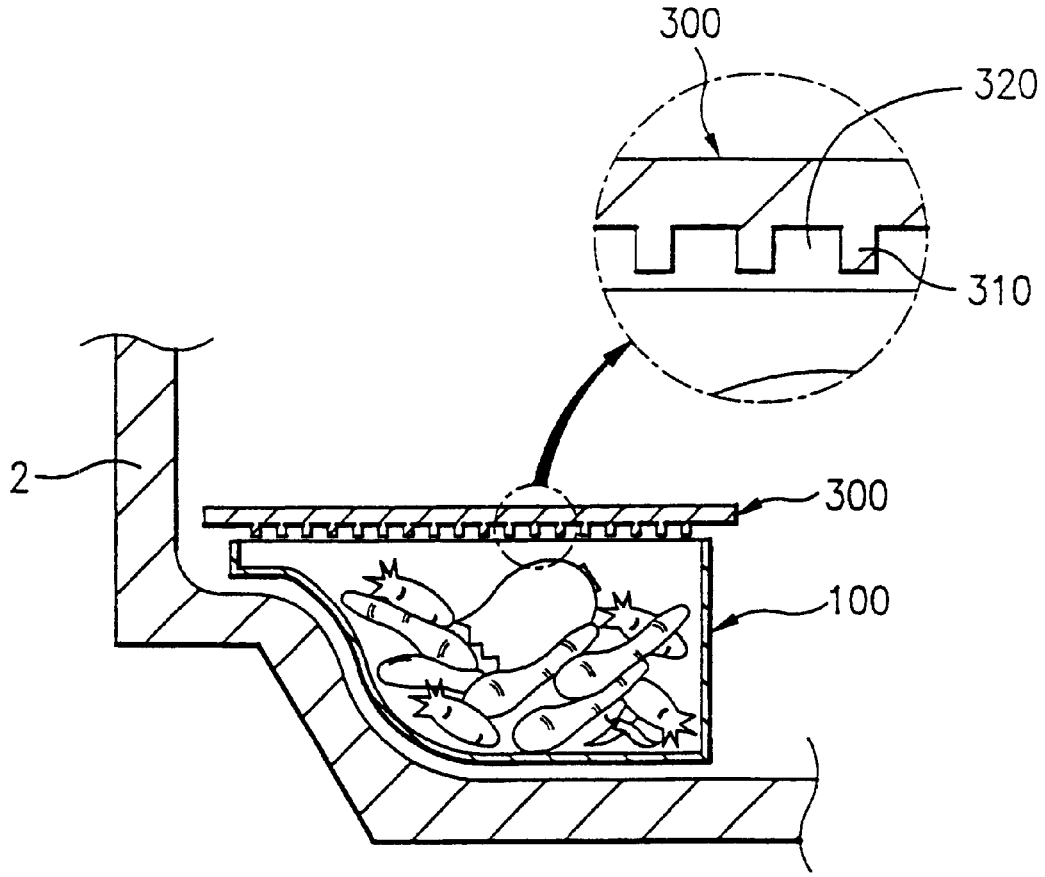

FIG. 10 illustrates a side section of a vegetable compartment in accordance with a second preferred embodiment of the present invention.

In the first embodiment of the present invention explained above, the vegetable compartment had a cover 200 coupled by a hinge or the like to a top portion of the container 100 separate from the partition 6, which is not convenient in putting in or taking out vegetables from the vegetable compartment because the container 100 should be pulled, before opening the cover 200. Consequently, referring to FIG. 9, the vegetable compartment in accordance with a second preferred embodiment of the present invention includes a partition 300 having water collecting means on a bottom surface thereof and a container 100. Other than formation of a vegetable storage space in the cold storage room 2 instead of the cover 200 in the first embodiment, the partition 300 serves to protect the vegetables in the container 100. Therefore, the partition 300 simplifies a structure of the vegetable compartment and permits to put in the vegetables in the vegetable compartment. Though FIG. 10 illustrates a partition 300 having water collecting means with ribs applied thereto, water collecting means with the strips may also be applicable, and the foregoing water collecting means in the second embodiment has substantially the same definition and modification with the first embodiment in terms of system and function. It can be known from the explanation of the first embodiment that the second embodiment vegetable compartment can make stable hold of water drops formed by the water collecting means on the partition 300 and maintains a humidity inside of the container, appropriately.

It will be apparent to those skilled in the art that various modifications and variations can be made in the vegetable compartment in a refrigerator of the present invention without departing from the spirit or scope of the invention. Thus, it is intended that the present invention cover the modifications and variations of this invention provided they come within the scope of the appended claims and their equivalents.

What is claimed is:

1. A vegetable compartment in a refrigerator comprising:

a partition for forming a vegetable storage space in a cold storage room;

a container accommodated in the vegetable storage space; and a cover over the container, the cover having water collecting means to collect on a bottom surface, wherein condensed moisture on the bottom surface is collected and contained in the water collecting means by surface tension.

2. A vegetable compartment as claimed in claim 1, wherein the water collecting means includes;

a plurality of ribs formed to cross one another each having a predetermined width and a predetermined height extended downward, and a plurality of water collecting spaces formed by the ribs.

3. A vegetable compartment as claimed in claim 1, further comprising supplementary water collecting means for substantially increasing a surface area of the water collecting means.

4. A vegetable compartment as claimed in claim 3, wherein the supplementary water collecting means is a cavity formed at ends of the ribs.

5. A vegetable compartment as claimed in claim 4, wherein the cavity is formed at a cross of the ribs.

6. A vegetable compartment as claimed in claim 5, wherein the cavity is semispherical.

7. A vegetable compartment as claimed in claim 3, wherein the supplementary water collecting means includes;

a supplementary rib in the water collecting space, and a supplementary water collecting space formed by the supplementary rib.

8. A vegetable compartment as claimed in claim 7, wherein the supplementary rib has a height lower than a height of the rib.

9. A vegetable compartment as claimed in claim 8, wherein the supplementary rib is a cross form.

10. A vegetable compartment as claimed in claim 8, wherein the supplementary rib is circular.

11. A vegetable compartment as claimed in claim 3, wherein the supplementary water collecting means includes;

a cavity formed at ends of the ribs, and a supplementary rib formed in the water collecting space and a supplementary water collecting space formed by the supplementary rib.

12. A vegetable compartment as claimed in claim 1, wherein the water collecting means includes;

a plurality of metal strips each having a predetermined width and a predetermined thickness crossed one another, and a plurality of water collecting spaces formed by the strips.

13. A vegetable compartment as claimed in claim 12, wherein the cover comprises the water collecting means only.

14. A vegetable compartment in a refrigerator comprising:

a partition for forming a vegetable storage space in a cold storage room, the partition having water collecting means on a bottom surface; and a container accommodated in the vegetable storage space, wherein condensed moisture on the bottom surface is collected and contained in the water collecting mean by surface tension.

15. A vegetable compartment as claimed in claim 14, wherein the water collecting means includes;

a plurality of ribs formed to cross one another each having a predetermined width and a predetermined height extended downward, and a plurality of water collecting spaces formed by the ribs.

16. A vegetable compartment as claimed in claim 14, wherein the water collecting means includes;

a plurality of metal strips arranged to cross one another each having a predetermined width and a predetermined height extended downward, and a plurality of water collecting spaces formed by the strips.

* * * * *